US008146576B2

(12) United States Patent
Hu

(10) Patent No.: US 8,146,576 B2
(45) Date of Patent: Apr. 3, 2012

(54) FIRING ACTUATOR MECHANISM FOR TOY GUN

(76) Inventor: Shih-Che Hu, Yung Kang (TW)

( * ) Notice: Subject to any disclaimer, the term of this patent is extended or adjusted under 35 U.S.C. 154(b) by 280 days.

(21) Appl. No.: 12/689,240

(22) Filed: Jan. 19, 2010

(65) Prior Publication Data

US 2011/0174283 A1 Jul. 21, 2011

(51) Int. Cl.
*F41B 7/08* (2006.01)

(52) U.S. Cl. ..... 124/31

(58) Field of Classification Search ..... 124/16, 124/27, 28, 31, 73, 74
See application file for complete search history.

(56) References Cited

U.S. PATENT DOCUMENTS

| | | | | |
|---|---|---|---|---|
| 5,634,456 | A * | 6/1997 | Perrone | 124/76 |
| 7,077,117 | B1 * | 7/2006 | Chu | 124/32 |
| 7,305,980 | B2 * | 12/2007 | Liao | 124/31 |
| 7,588,023 | B2 * | 9/2009 | Kung et al. | 124/27 |

* cited by examiner

*Primary Examiner* — John Ricci
(74) *Attorney, Agent, or Firm* — Pro-Techtor Int'l Services

(57) ABSTRACT

A firing actuator mechanism used in a toy gun is disclosed to include a trigger mechanism, a link having a push portion and a stop portion at the rear side thereof, a retaining mechanism formed of a holder block and a sliding block, a hammer and a locking block. The sliding block has an engagement portion at the front side, and a first side rod and a second side rod at one lateral side. When the link is moved backwards during a single fire mode, the push portion forces the first side rod to move the sliding block backwards. When the link is moved backwards and the rear end portion is forced downwards during a continuous fire mode, the stop portion is stopped against the second side rod of the sliding block. The hammer has a durable press portion lockable by the locking mechanism.

5 Claims, 15 Drawing Sheets

FIRING ACTUATOR MECHANISM FOR TOY GUN

BACKGROUND OF THE INVENTION

1. Field of the Invention

The present invention relates to toy guns and more particularly, to a firing actuator mechanism for toy gun, which simplifies the structure of the retaining mechanism and enhances the structural strength of the press portion of the hammer.

2. Description of the Related Art

Referring to FIG. 1, a conventional toy gun's firing actuator mechanism "a" is shown comprising a trigger mechanism 10, a link 20, a retaining mechanism 30, a hammer 40 and a locking block 50 (see also FIGS. 2 and 3). The link 20 has a front end portion 20 and a rear end portion 202 (see FIGS. 2 and 3). The front end portion 201 of the link 20 is connected to the top side of the trigger mechanism 10 and loaded with a spring member 401 that returns the link 20 each time the link 20 having been moved. The rear end portion 202 of the link 20 is pivotally connected to the retaining mechanism 30. The retaining mechanism 30 comprises two actuating rods 301 and a plurality of pivoted connecting rods 302 (see FIG. 3). One actuating rod 301 has a front end terminating in a retaining portion 303. The hammer 40 is biasable back and forth, having a hook portion 401 and an elastic press portion 402. When the hammer 40 is biased backwards, the hook portion 401 is hooked on the retaining portion 303 of the retaining mechanism 30. The locking block 50 has a locking tip 501. When the hammer 40 is biased backwards to force the hook portion 401 into engagement with the retaining portion 303 of the retaining mechanism 30, the locking tip 501 of the locking block 50 is forced into engagement with the press portion 402 of the hammer 40. When the locking block 50 is moved forwards, the locking tip 501 of the locking block 50 is released from the press portion 402 of the hammer 40.

Further, a control block 60 is operable to control the operation mode (safe mode (non-fire mode), single lire mode (sec FIG. 4) or continuous fire mode (see FIG. 5)). When the control block 60 is switched to the single fire mode, the bolt body 70 is moved backwards, and the hammer 40 is biased backwards by the bolt body 70 (see FIG. 2). At this time, the locking tip 501 of the locking block 50 is forced into engagement, with the press portion 402 of the hammer 40, and the retaining portion 303 of the retaining mechanism 30 is moved to the top side of the hook portion 401 of the hammer 40 (see FIG. 6). Thereafter, the bolt body 70 is moved slightly forwards to push the locking block 50, causing the locking tip 501 of the locking block 50 to be released from the press portion 402 of the hammer 40, for enabling the retaining portion 303 of the retaining mechanism 30 to retain the hook portion 401 of the hammer 40 (see FIG. 6). When the trigger of the toy gun is pressed to move the link 20 backwards, the actuating rods 301 of the retaining mechanism 30 are synchronously moved (see FIG. 7), causing the retaining portion 303 to be disengaged from the hook portion 401 of the hammer 40 for allowing the hammer 40 to be biased forwards to hammer (see FIG. 8). When the user presses the trigger and holds the trigger pressed after the control block 60 has been switched to the continuous fire mode, the bolt body 70 is continuously and alternatively moved back and forth (see FIG. 2), and the locking tip 501 of the locking block 50 is continuously and alternatively forced into engagement with and released from the press portion 402 of the hammer 40 (see FIG. 9). At this time, the two actuating rods 301 are opened, the retaining portion 303 is released from the hook portion 401 of the hammer 40, and the holt body 70 is moved forwards for causing the locking tip 501 of the locking block 50 to be moved away from the press portion 402 of the hammer 40, thus the hammer 40 can be continuously biased forwards and backwards to fire toy bullets one by one (see FIG. 10).

According to the aforesaid conventional toy gun's firing actuator mechanism "a", the linking design of the retaining mechanism 30 is complicated, resulting in complicated installation procedure and high manufacturing cost. Further, the operation of the firing actuator mechanism is sometimes inaccurate. Further, the press portion 402 of the hammer 40 will become elastic fatigue alter a long use causing an operation failure.

SUMMARY OF THE INVENTION

The present invention has been accomplished under the circumstances in view. It is one object of the present invention to provide a firing actuator mechanism for toy gun, which simplifies the structural design of the retaining mechanism and assures positive linking operation for achieving a single fire mode and continuous fire mode accurately. It is still another object of the present invention to provide a firing actuator mechanism for toy gun, which has high durability.

To achieve these and other objects of the present invention, a firing actuator mechanism is used in a toy gun for performing a single fire mode and a continuous fire mode selectively. The firing actuator mechanism comprises a trigger mechanism, a link, a retaining mechanism, a hammer and a locking block. The link has a front end portion connected to the top side of the trigger mechanism and a rear end portion pivoted to the retaining mechanism. The retaining mechanism has an engagement portion. The hammer has a hook portion and a fixed press portion. The hook portion of the hammer is forced into engagement with the engagement portion of the retaining mechanism when the hammer is biased backwards. The locking block has a locking tip. The locking tip is forced into engagement with the press portion of the hammer when the hammer is biased backwards, or disengaged from the press portion of the hammer when the locking block is moved forwards. Further, the link has a bearing portion located on the top side of the rear end portion thereof, a push portion located on one lateral side of the rear end portion and a stop portion located on the same lateral side of the rear end portion and spaced behind the push portion. The retaining mechanism comprises a holder block, a sliding block axially movable in and out of the holder block and carrying the engagement portion at the front side thereof. The sliding block has a first side rod and a second side rod arranged at one lateral side thereof corresponding to the push portion and stop portion of the link. The first side rod is forced by the push portion to move the sliding block backwardly into the inside of the holder block in disengaging the engagement portion from the hook portion of the hammer when the link is moved backwards. The push portion of the link is moved to the bottom side of the first side rod of the sliding block and the stop portion or the link is stopped against the second side rod of the sliding block when the bearing portion of the link is forced downwards by the bolt body to lower the rear end portion of the link. The press portion of the hammer is a rigid structure fixedly located on the lateral side of the hammer.

Further, the holder block of the retaining mechanism has a chamber defined therein for receiving the sliding block and a spring member mounted in the chamber and connected with the rear side of the sliding block. The sliding block has a longitudinal sliding slot coupled to the holder block by a pin that limits sliding movement of the sliding block relative to the holder block to a predetermined distance. The engagement portion is moved out of the holder block when the sliding block is moved forwards relative to the holder block. The first side rod and the second side rod of the sliding block are suspending out of one side of the holder block. Further, the engagement portion is forced into engagement with the hook portion of the hammer when the link is moved backwards and the rear end portion of the link is lowered during the single fire mode. And, the engagement portion is disengaged from the hook portion of the hammer when the link is moved backwards and the rear end portion of the link is lowered during the continuous fire mode.

DETAILED DESCRIPTION OF THE PREFERRED EMBODIMENT

Figure 1:
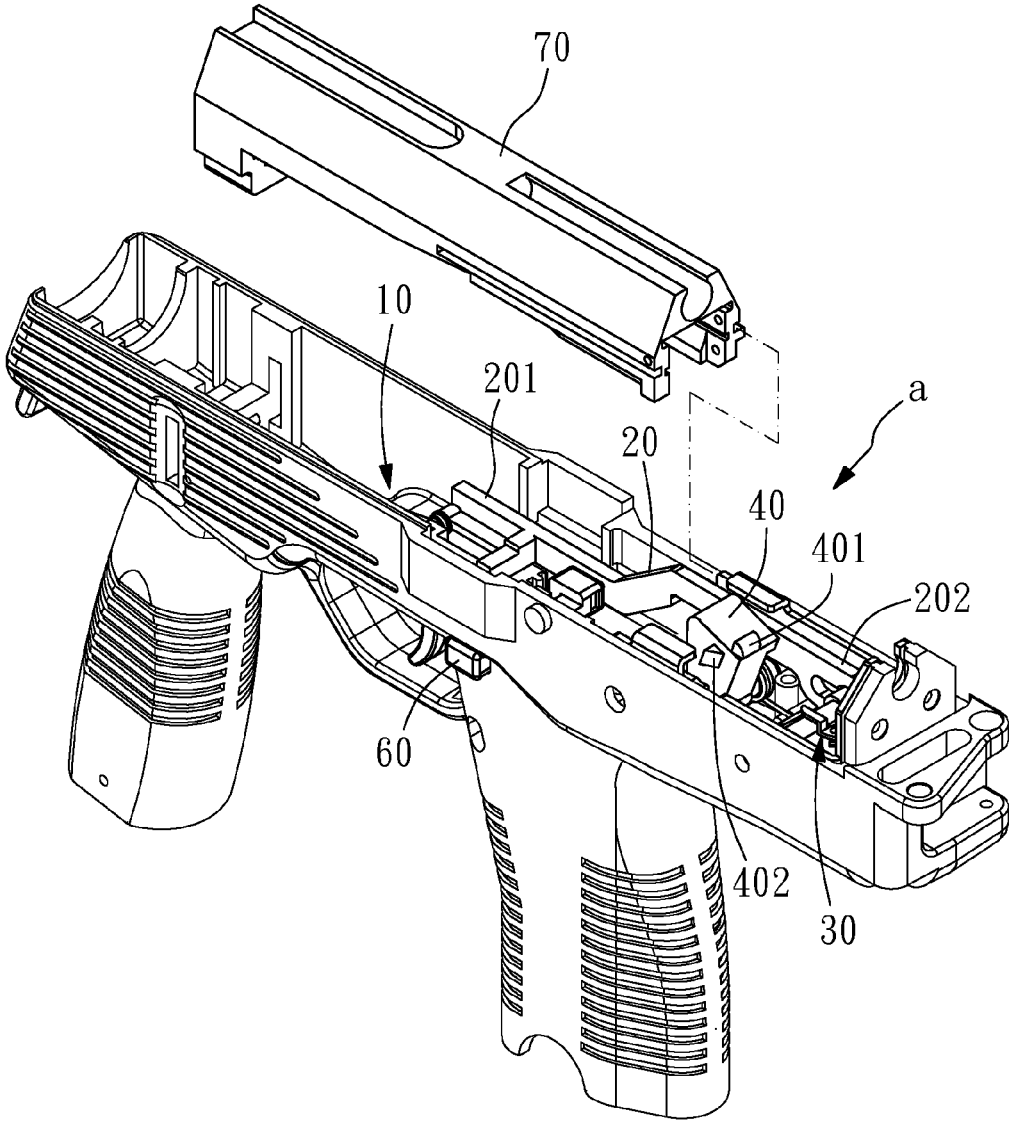
FIG. 1 (PRIOR ART)
FIG. 1 is an elevational assembly view of a firing actuator mechanism for toy gun according to the prior art.
Figure 2:
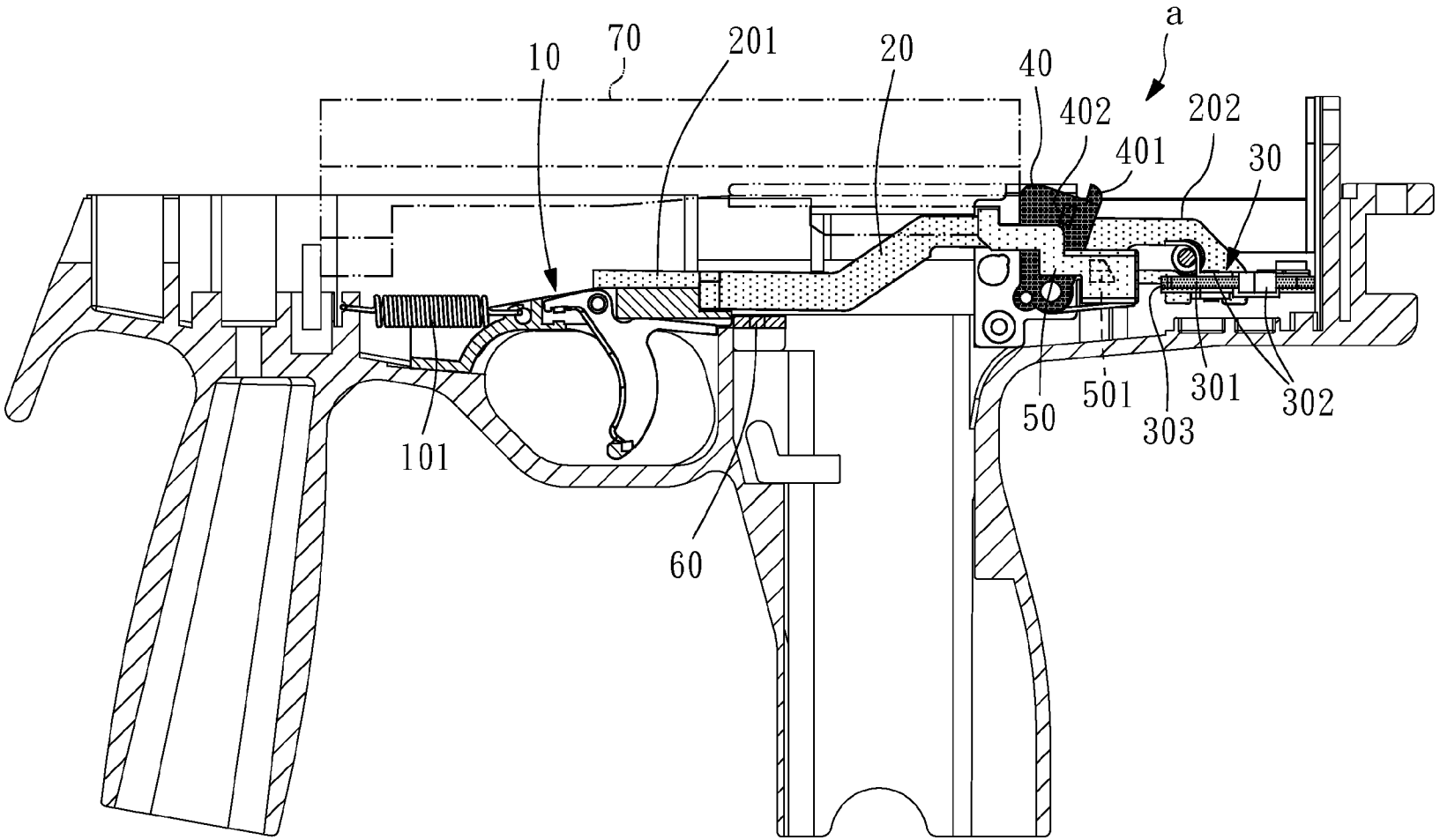
FIG. 2 (PRIOR ART)
FIG. 2 is a schematic side view of the firing actuator mechanism according to the prior art.
Figure 3:
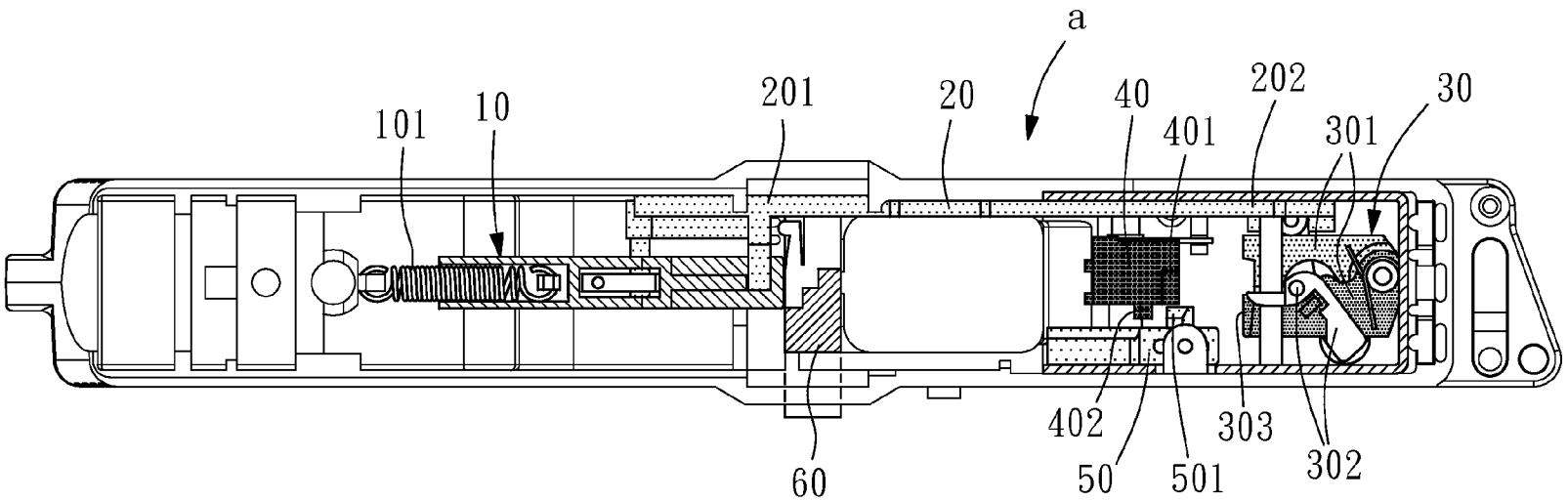
FIG. 3 (PRIOR ART)
FIG. 3 is a schematic top plain view of the firing actuator mechanism according to the prior art.
Figure 4:
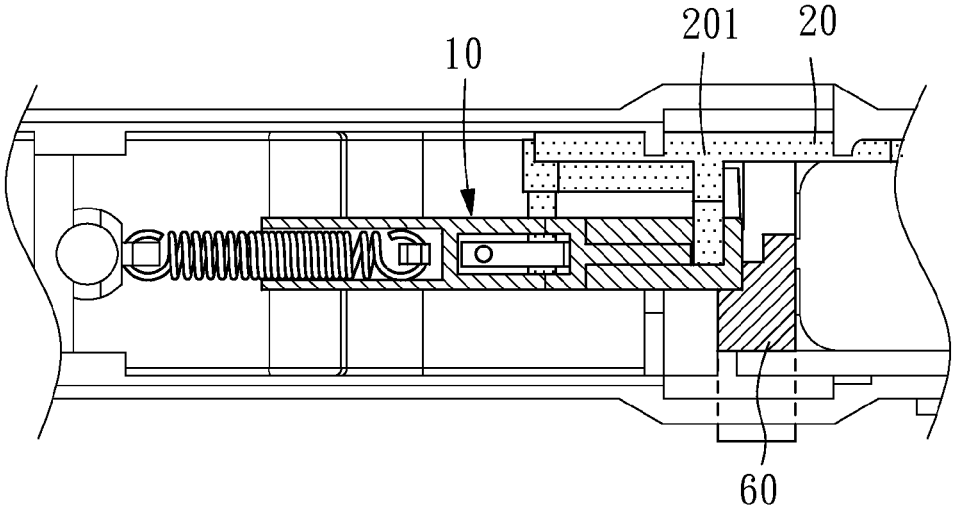
FIG. 4 (PRIOR ART)
FIG. 4 is a schematic plain view of the prior art design, showing the status of the firing actuator mechanism when the control block switched to the single fire mode.
Figure 5:
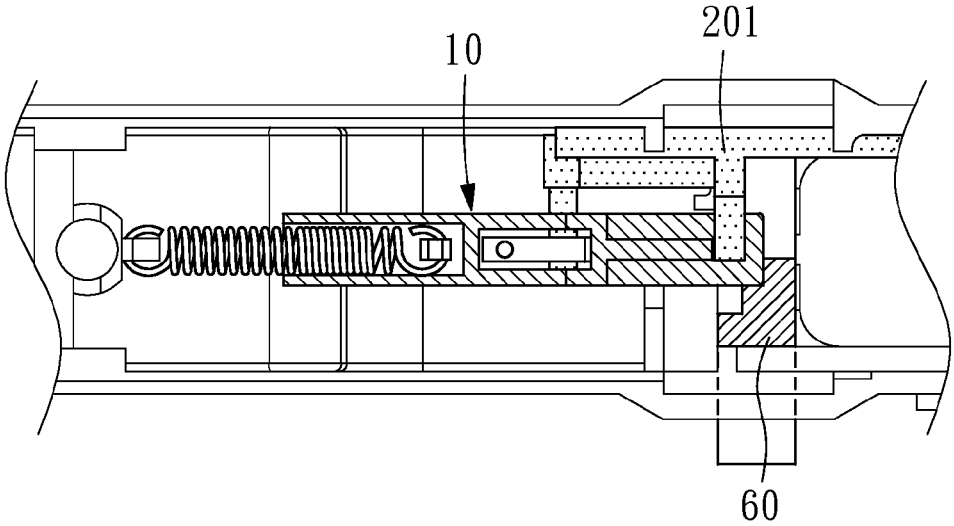
FIG. 5 (PRIOR ART)
FIG. 5 is a schematic plain view of the prior art design, showing the status of the firing actuator mechanism when the control block switched to the continuous fire mode.
Figure 6:
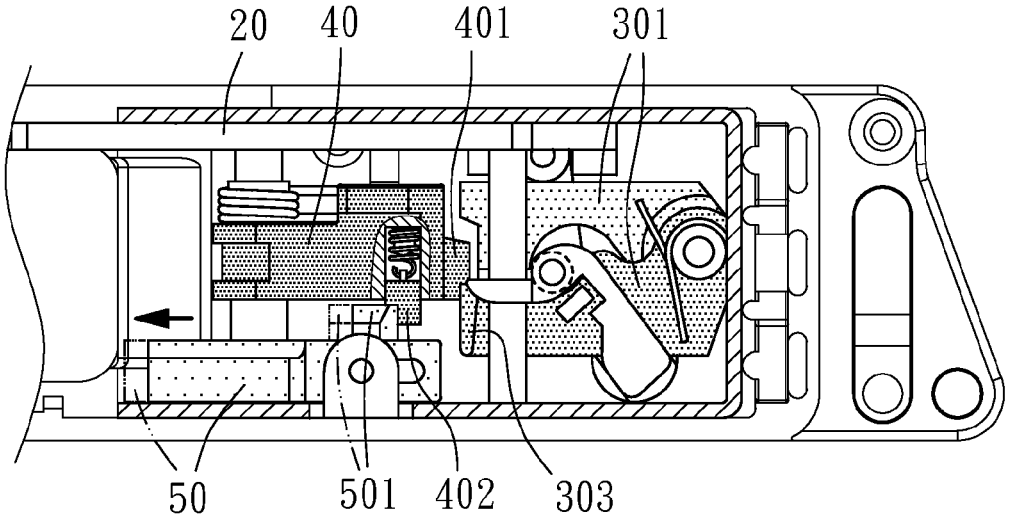
FIG. 6 (PRIOR ART)
FIGS. 6~8 illustrate the operation of the prior art firing actuator mechanism under the single fire mode.
Figure 7:
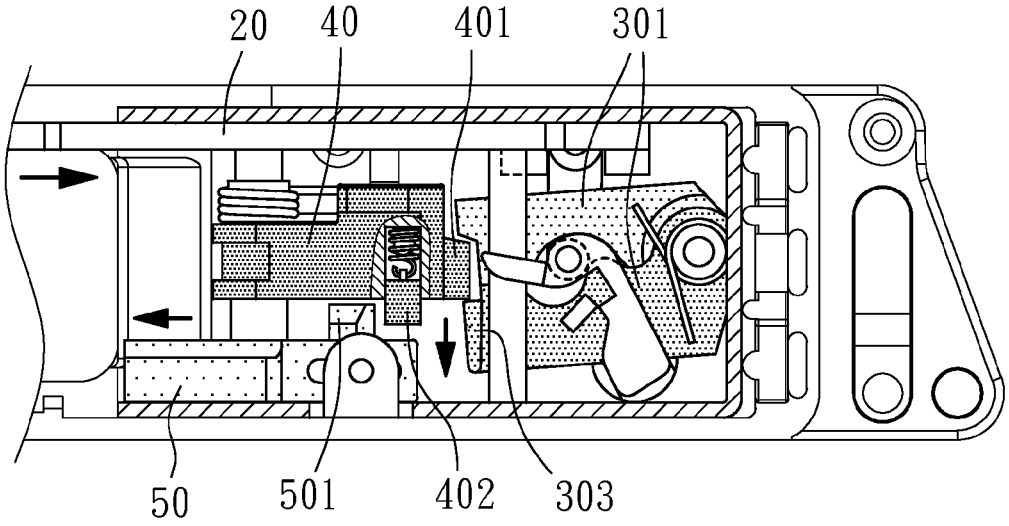
FIG. 7 (PRIOR ART)
Figure 8:
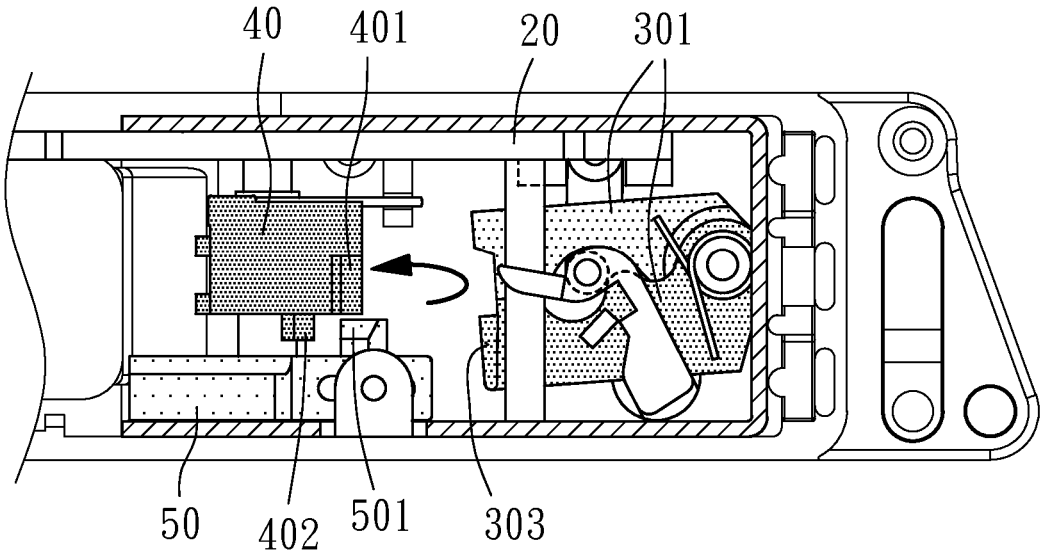
FIG. 8 (PRIOR ART)
Figure 9:
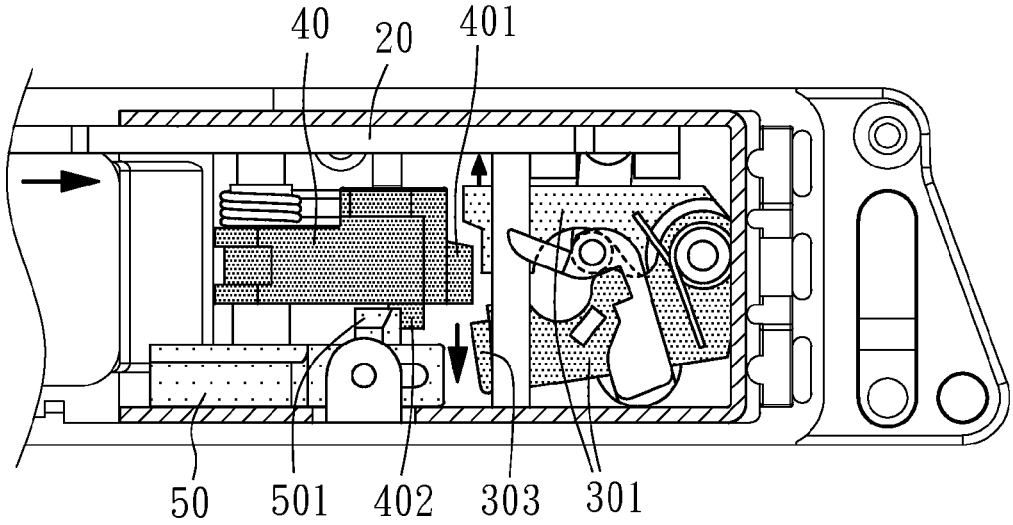
FIG. 9 (PRIOR ART)
FIGS. 9~10 illustrate the operation of the prior art firing actuator mechanism under the continuous fire mode.
Figure 10:
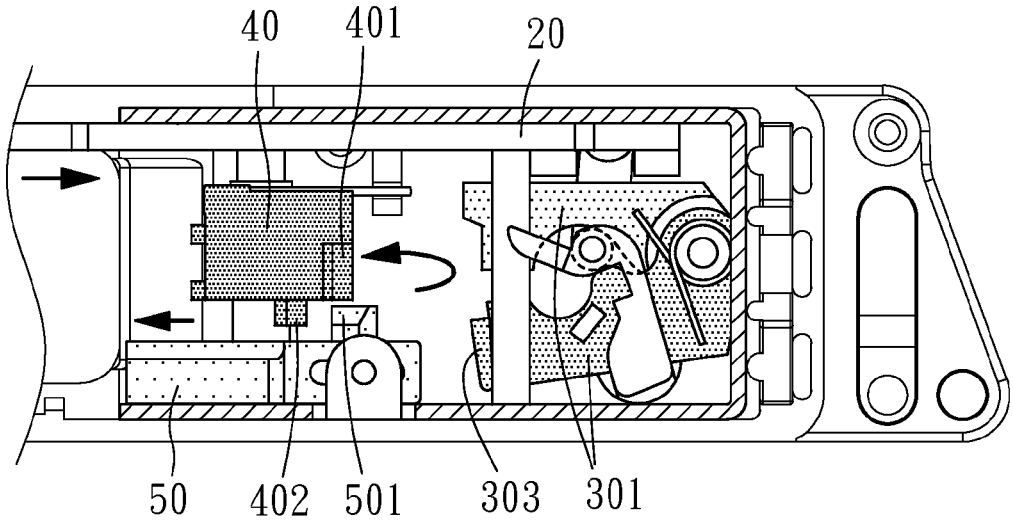
FIG. 10 (PRIOR ART)
Figure 11:
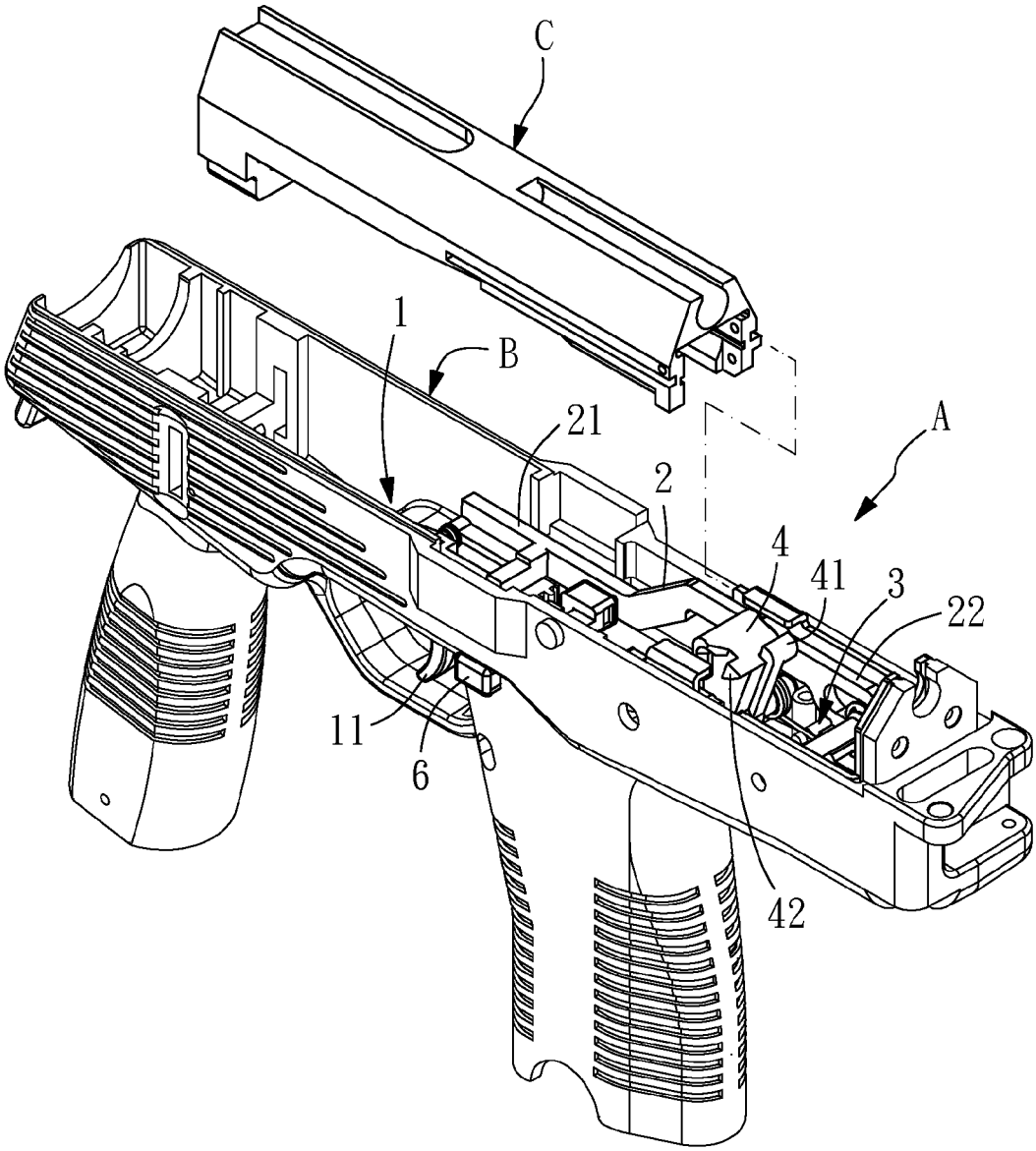
FIG. 11 is an devotional assembly view of a firing actuator mechanism for toy gun according to the present invention.
Figure 12:
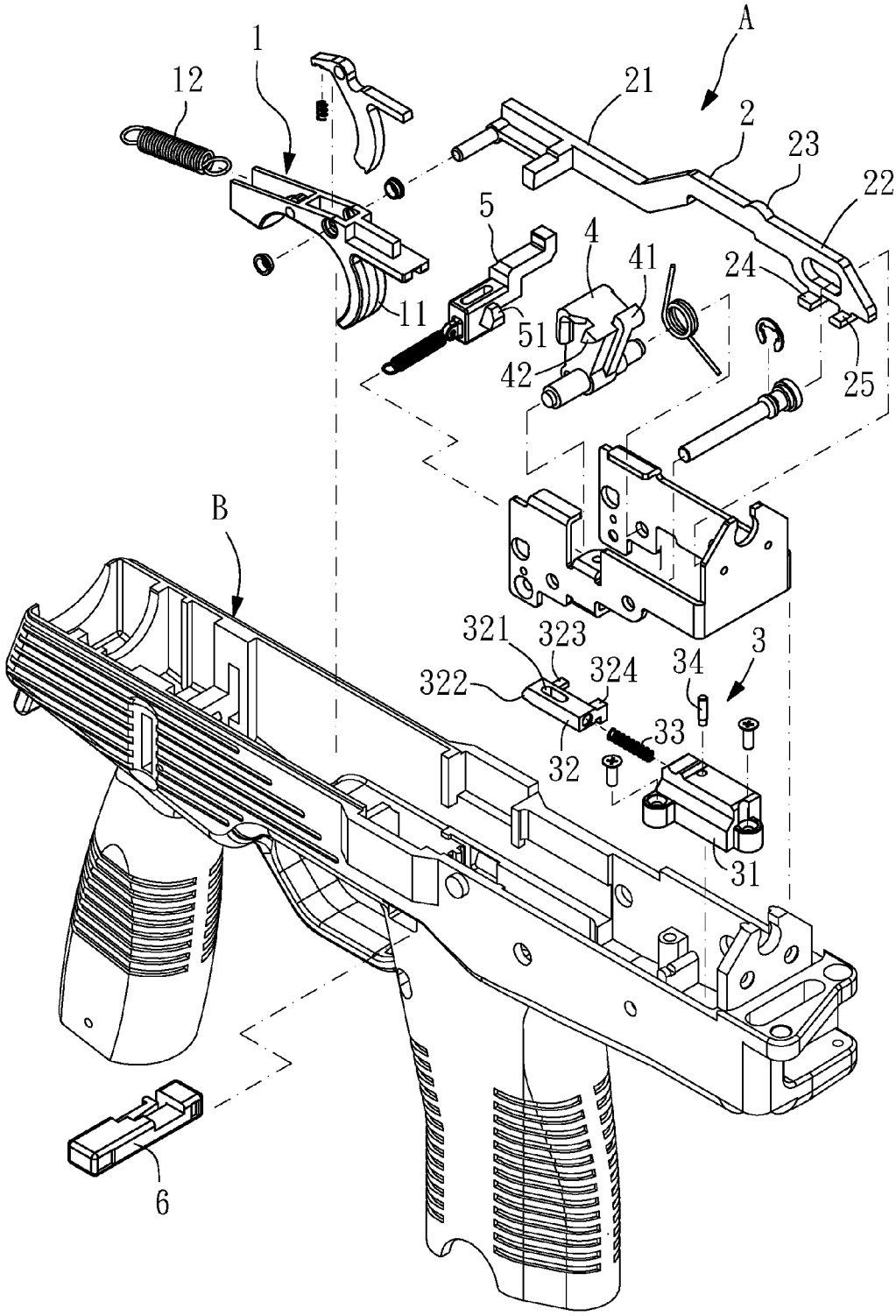
FIG. 12 is an exploded view of the firing actuator mechanism for toy gun according to the present invention.
Figure 13:
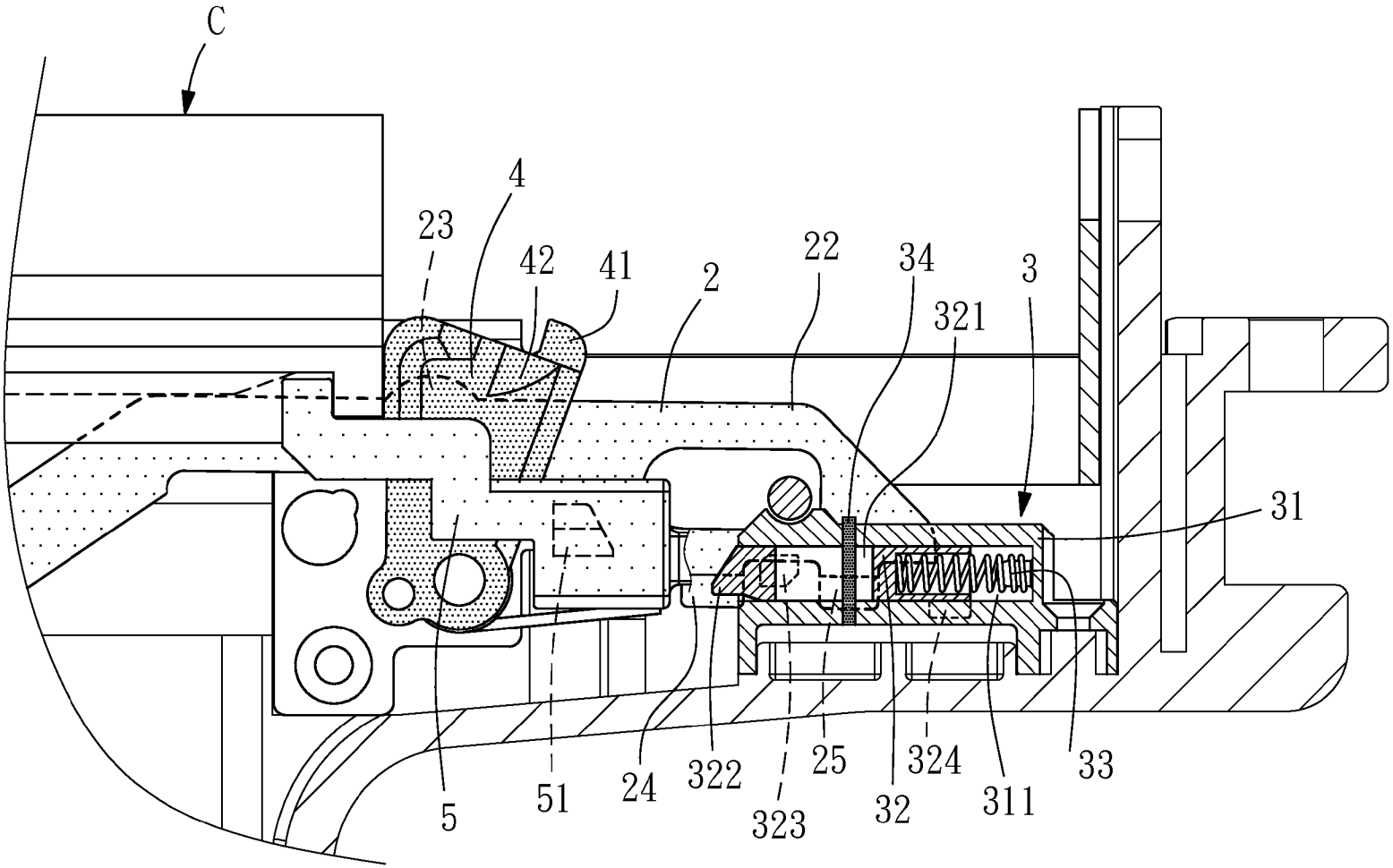
FIG. 13 is a schematic sectional side view of the firing actuator mechanism for toy gun according to the present invention.
Figure 14:
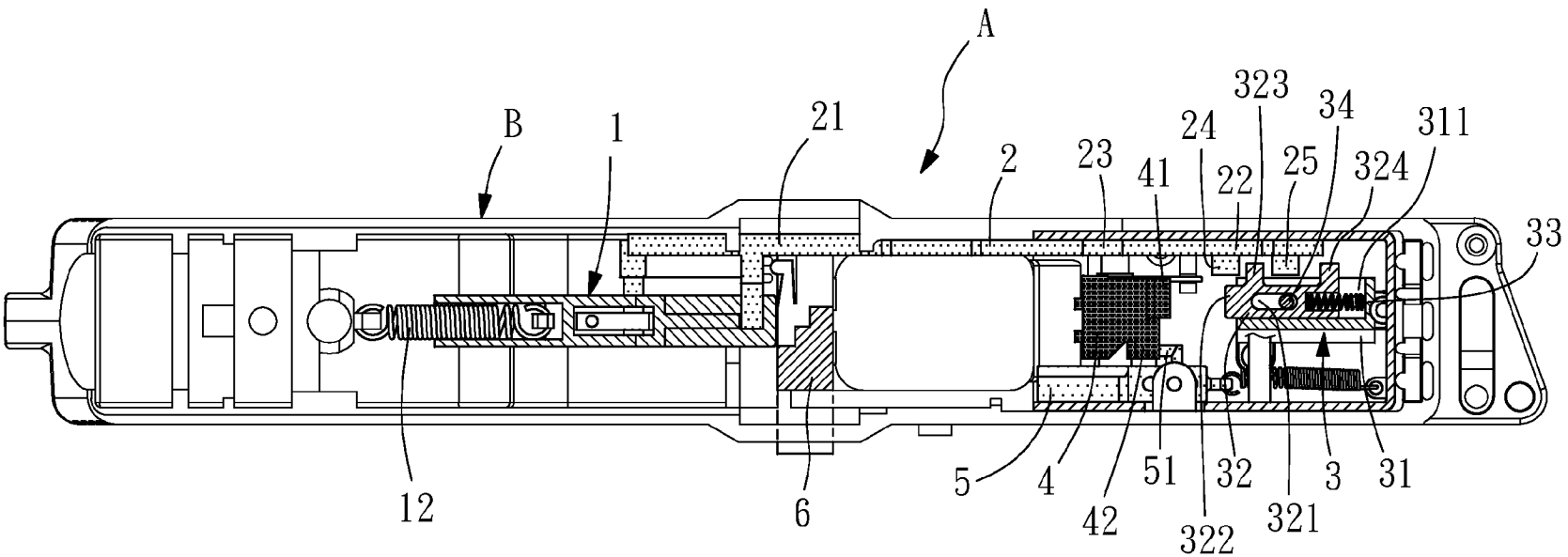
FIG. 14 is a schematic top plain view of the firing actuator mechanism for toy gun according to the present invention.

Referring to FIGS. 11 and 12, a firing actuator mechanism A in accordance with the present invention is shown installed in the gun body B of a toy gun beneath the bolt body C (sec FIG. 11). The firing actuator mechanism A comprises a trigger mechanism 1, a link 2, a retaining mechanism 3, a hammer 4 and a locking block 5 (the structure of the locking block 5 is shown in FIGS. 12~14).

The trigger mechanism 1 comprises a trigger 11 pivotally mounted in the gun body B (see FIG. 12), and a spring member 12 connected between the trigger 11 and the gun body B.

The link 2 has a front end portion 21 and a rear end portion 22. The front end portion 21 of the link 2 is connected to the top side of the trigger mechanism 1 (see FIGS. 12 and 14). Subject to the effect of the spring member 12, the link 2 can be returned to the front side after having been moved backwards. The rear end portion 22 of the link 2 is pivotally connected to the retaining mechanism 3. The link 2 further has a bearing portion 23 protruded from the top side of the rear end portion 22, a push portion 24 located on one lateral side of the rear end portion 22 and a stop portion 25 disposed adjacent to and behind the push portion 24.

The retaining mechanism 3 comprises a holder block 31, a sliding block 32, a spring member 33 and a pin 34 (see FIG. 12). The holder block 31 is fixedly mounted in the gun body B, defining therein a chamber 311 (see FIG. 13) for receiving the sliding block 32. The spring member 33 is connected between a part inside the chamber 311 and the rear side of the sliding block 32 for moving the sliding block 32 forwards to its former position after the sliding block 32 having been moved backwards. The sliding block 32 has a longitudinal sliding slot 321. The pin 34 is inserted through the longitudinal sliding slot 321 and affixed to the holder block 31 to limit the range of sliding movement of the sliding block 32 relative to the holder block 31. The sliding block 32 further has an engagement portion 322, a first side rod 323 and a second side rod 324. The first side rod 323 and the second side rod 324 are disposed corresponding to the push portion 24 and the stop portion 25 of the link 2 (see FIGS. 13 and 14). When the sliding block 32 is moved forwards to its former position, the engagement portion 322 protrudes over the front side of the holder block 31. Further, the first side rod 323 and the second side rod 324 extend out of one lateral side of the holder block 31 (see FIG. 14).

The hammer 4 is pivotally mounted in the gun body B, having a hook portion 41 and a press portion 42 (see FIG. 12). When the hammer 4 is biased backwards, the hook portion 41 is forced into engagement with the engagement portion 322. Further, the press portion 42 is formed integral with a part of the hammer 4.

The locking block 5 is spring-loaded and axially movably mounted in the gun body 8, having a locking tip 51 (see FIG. 12). When the hammer 4 is biased backwards, the locking tip 51 is forced into engagement with the press portion 42 of the hammer 4. When the locking block 5 is moved forwards, the locking tip 51 is disengaged from the press portion 42.

Figure 15:
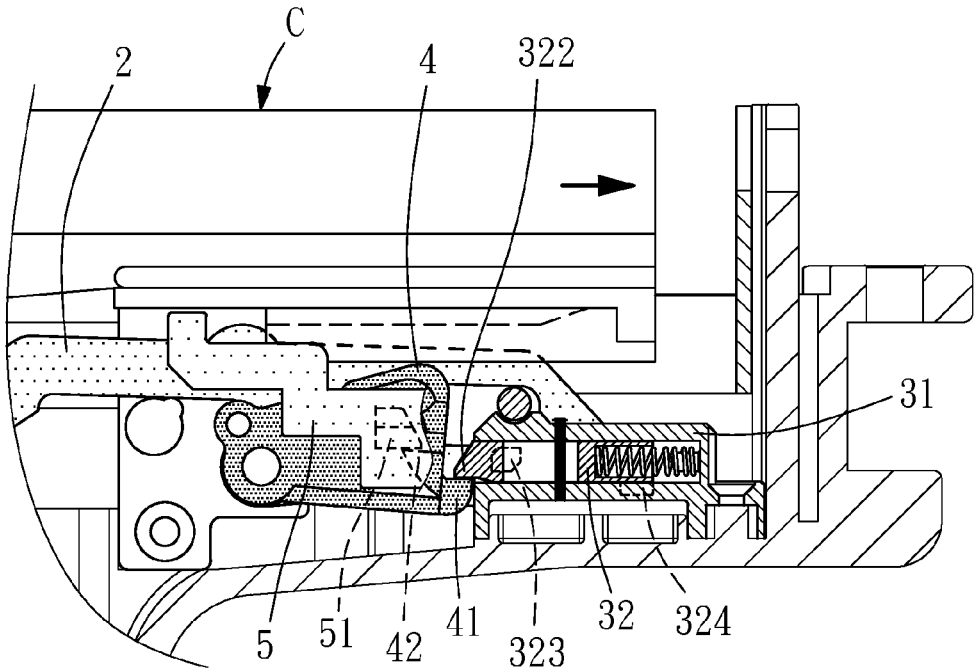
FIGS. 15~17 illustrate the operation of the firing actuator mechanism for toy gun according to the present invention under the single fire mode.
Figure 16:
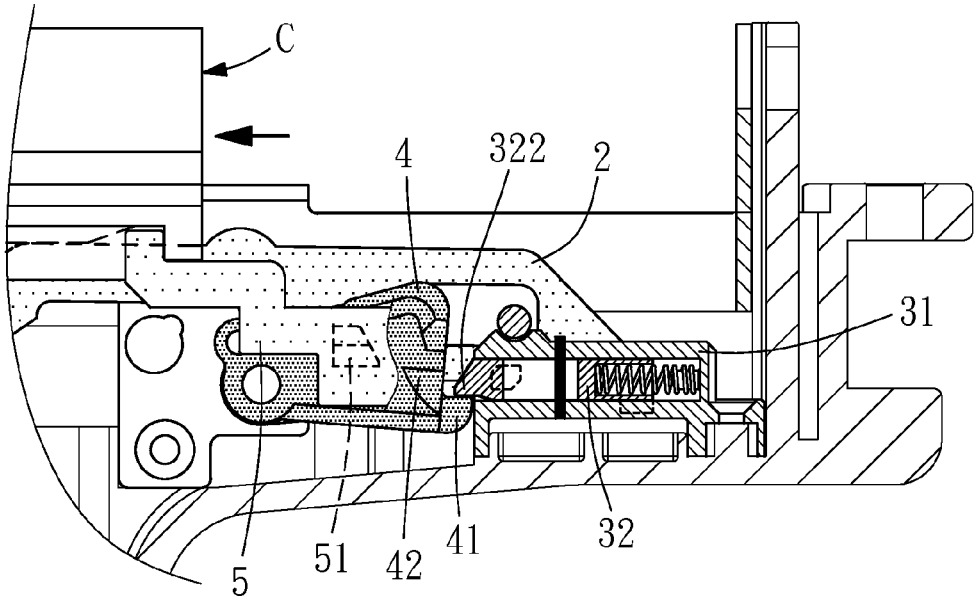
Figure 17:
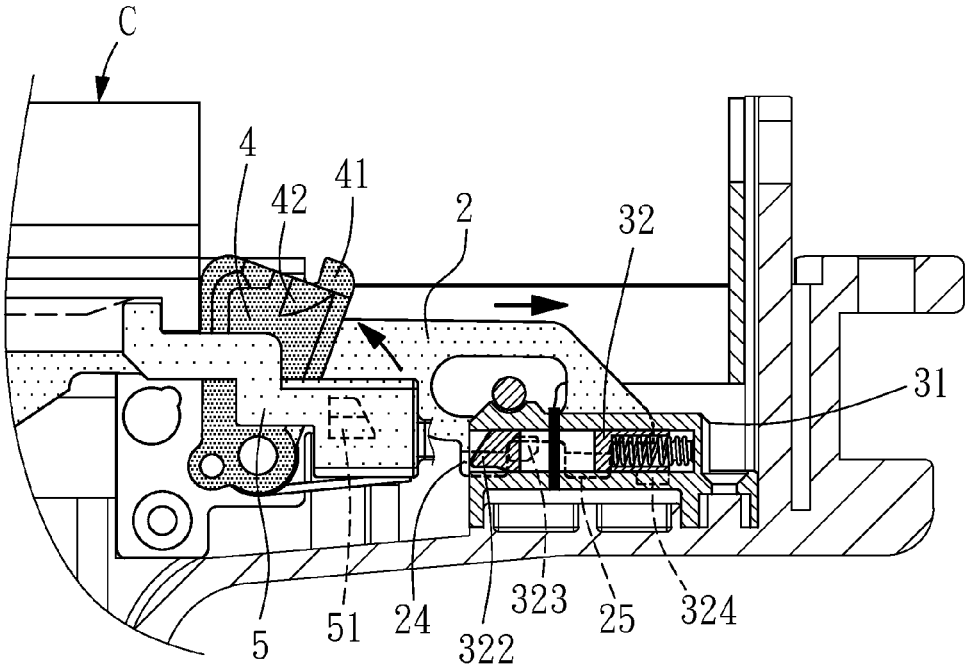
Figure 18:
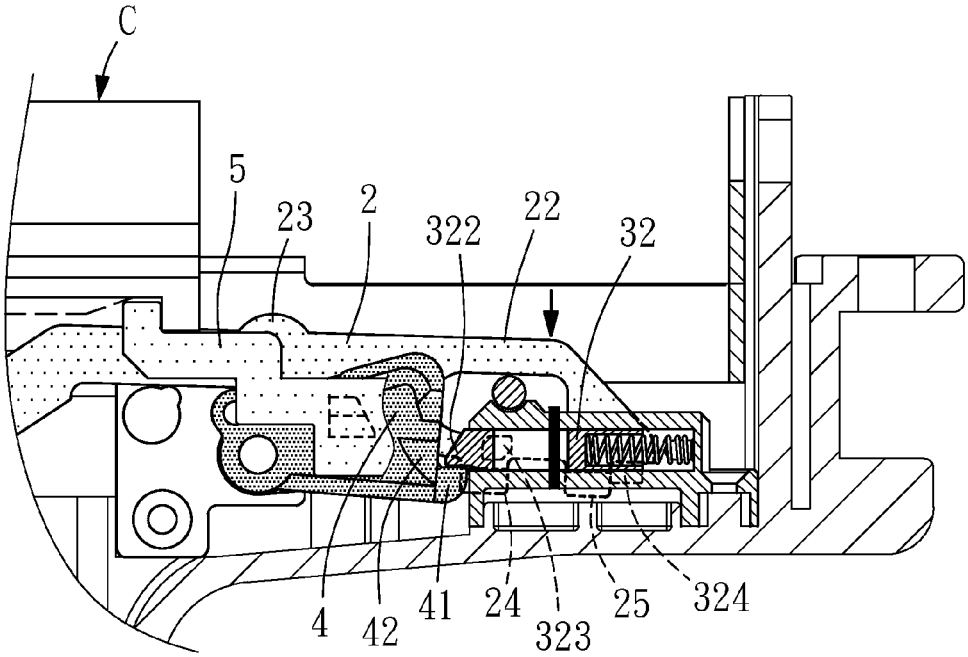
FIG. 18 illustrates a status of the firing actuator mechanism for toy gun according to the present invention during the single fire mode.

Further, a control block 6 is operable to control the operation mode (safe mode (non-fire mode), single fire mode or continuous fire mode). When the control block 6 is switched to the single fire mode, the bolt body C is moved backwards (see FIG. 15), and the hammer 4 is biased backwards by the bolt body C. At this time, the locking tip 51 of the locking block 5 is forced into engagement with the press portion 42 of the hammer 4; the engagement portion 322 of the retaining mechanism 3 is stopped at the top side of the hook portion 41 of the hammer 4; the bolt body C is moved backwards and then moved slightly forwards to pull the locking block 5, thereby disengaging the locking tip 51 of the locking block 5 from the press portion 42 of the hammer 4 (see FIG. 16) and causing the hook portion 41 of the hammer 4 to be hooked up with the engagement portion 322 of the retaining mechanism 3. Thus, when the trigger 11 is pressed to move the link 2 backwards (see FIGS. 11 and 12), the push portion 24 forces the first side rod 323 to move the sliding block 32 backwards (see FIG. 17), causing the engagement portion 322 of the retaining mechanism 3 to be moved away from the hook portion 41 of the hammer 4 for enabling the hammer 4 to fire toy bullet (not shown). Further, when the link 2 is moved backwards to lower the rear end portion 22 thereof during the single fire mode, the engagement portion 322 of the retaining mechanism 3 is engaged with the hook portion 41 of the hammer 4 (see FIG. 18).

Figure 19:
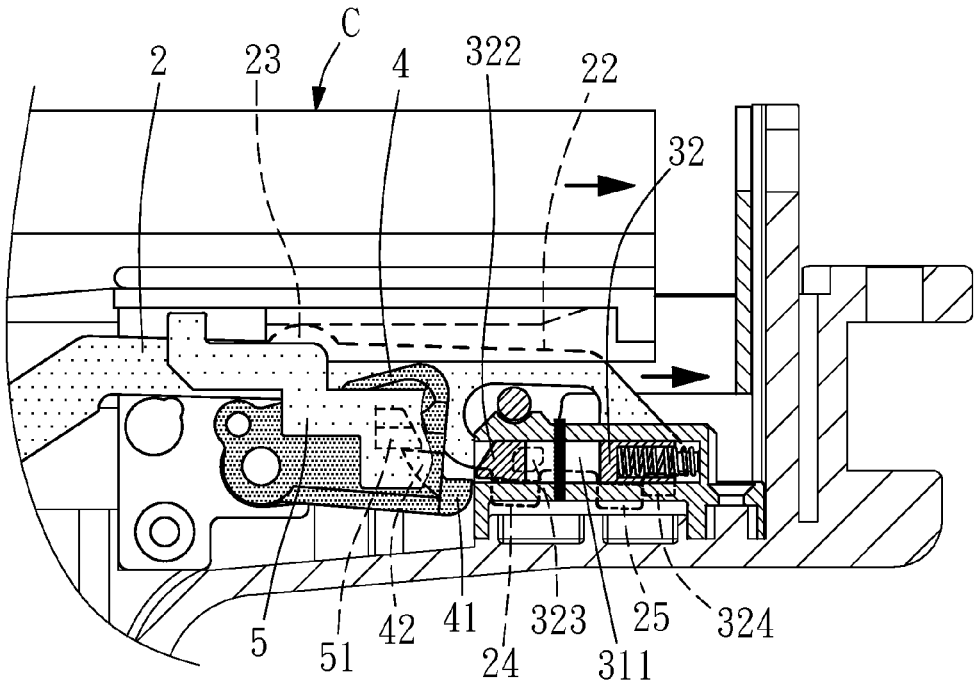
FIGS. 19~21 illustrate the operation of the firing actuator mechanism for toy gun according to the present invention under the continuous fire mode.
Figure 20:
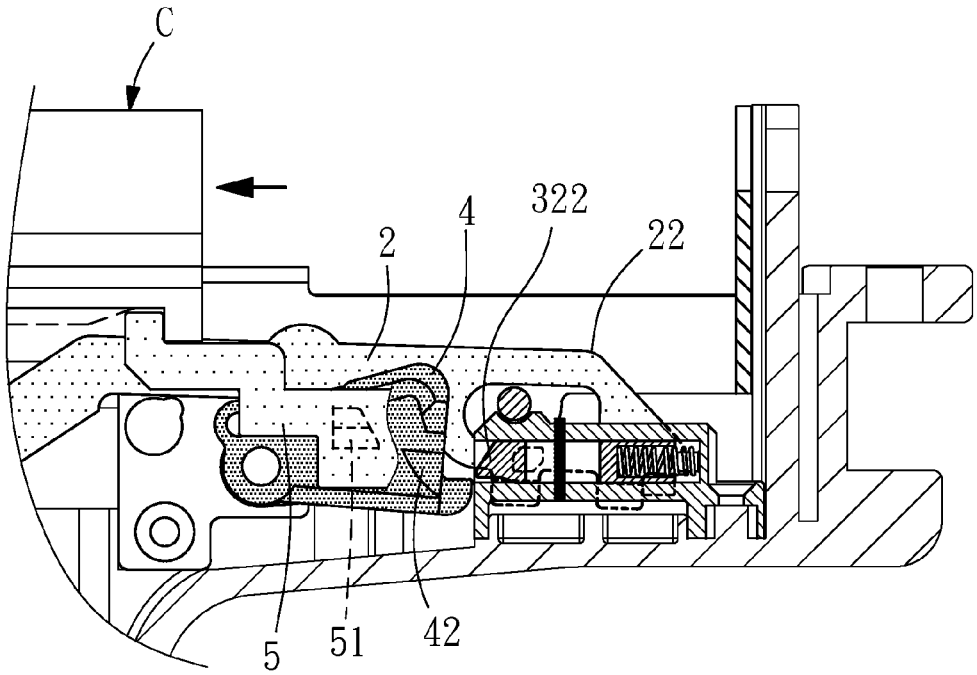
Figure 21:
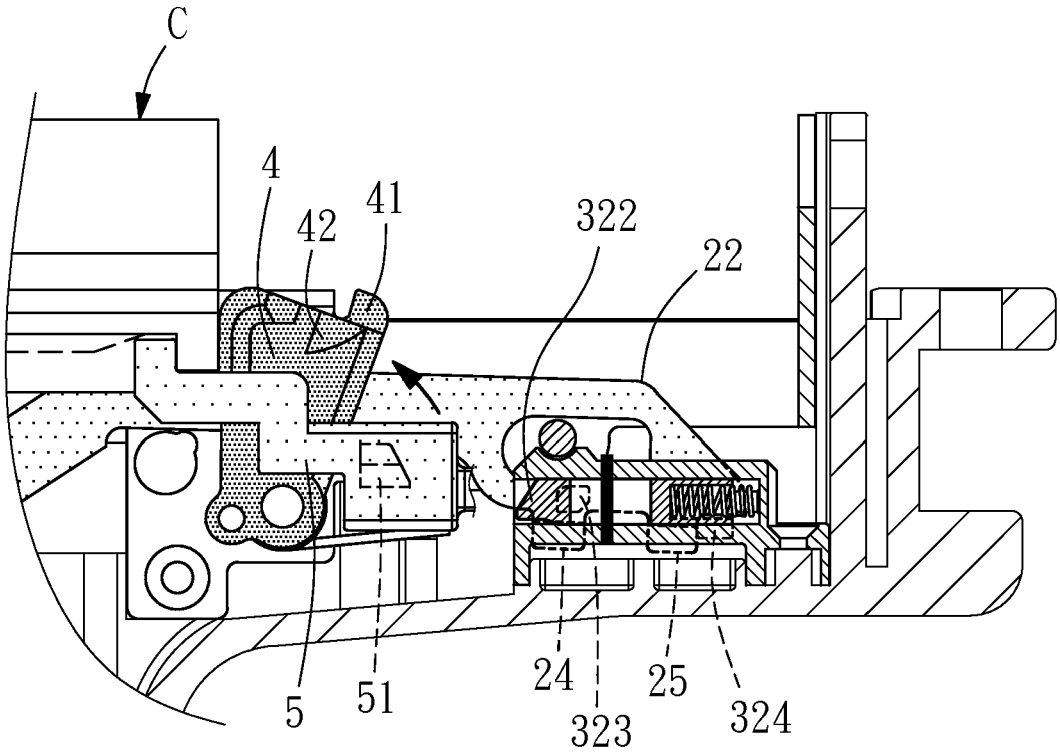

When the control block 6 is switched to the continuous fire mode, the bolt body C is moved backwards to bias the hammer 4 backwards and to cause the locking tip 51 of the locking block 5 to be forced into engagement with the press portion 42 of the hammer 4 (see FIG. 19). At this time the trigger 11 is held in the pressed condition, holding the link 2 in the backward position (see FIGS. 11 and 12) and the bearing portion 23 of the link 2 is forced downwards by the bolt body C, causing the push portion 24 of the link 2 to be moved to the bottom side of the first side rod 323 of the sliding block 32 and the stop portion 25 of the link 2 to be stopped against the second side rod 324 of the sliding block 32, and therefore the engagement portion 322 of the sliding block 32 is kept away from the hook portion 41 of the hammer 4 and received inside the chamber 311. Thereafter, the bolt body C is moved forwards to pull the locking block 5 (see FIG. 20), thereby causing the locking tip 51 of the locking block 5 to be moved away from the press portion 42 of the hammer 4 for enabling the hammer 4 to be biased forward to fire a toy bullet (sec FIG. 21). Thus, when the bolt body C is moved alternatively back and forth, the locking tip 51 of the locking block 5 is alternatively moved into engagement with and away from the press portion 42 of the hammer 4, enabling the hammer 4 to be alternatively biased forwards and backwards to fire toy bullets one by one.

As stated above, the linking arrangement of the sliding block 32 and the link 2 simplifies the structural design of the retaining mechanism 3 and assures positive linking operation for achieving a single fire mode and a continuous fire mode accurately. Because the press portion 42 is a rigid structure formed integral with the hammer 4, it has a high structural strength and is durable in use.

Although a particular embodiment of the invention has been described in described in detail for purposes of illustration, various modifications and enhancements may be made without departing from the spirit and scope of the invention. Accordingly, the invention is not to be limited except as by the appended claims.

What the invention claimed is:

1. A firing actuator mechanism used in a toy gun for performing a single fire mode and a continuous fire mode selectively, the firing actuator mechanism comprising a trigger mechanism, a link, a retaining mechanism, a hammer and a locking block, said link having a front end portion connected to a top side of said trigger mechanism and a rear end portion pivoted to said retaining mechanism, said retaining mechanism having an engagement portion, said hammer having a hook portion and a press portion, said hook portion of said hammer being forced into engagement with said engagement portion of said retaining mechanism when said hammer is biased backwards, said locking block having a locking tip, said locking tip being forced into engagement with said press portion of said hammer when said hammer is biased backwards, said locking tip being disengaged from said press portion of said hammer when said locking block is moved forwards, wherein:

said link has a bearing portion, a push portion located on one lateral side of said rear end portion and a stop portion located on the same lateral side of said rear end portion and spaced behind said push portion;

said retaining mechanism comprises a holder block, a sliding block axially movable in and out of said holder block and carrying said engagement portion at a front side thereof, said sliding block having a first side rod and a second side rod arranged at one lateral side thereof corresponding to said push portion and said stop portion of said link, said first side rod being forced by said push portion to move said sliding block backwardly into the inside of said holder block in disengaging said engagement portion from said hook portion of said hammer when said link is moved backwards, said push portion of said link being moved to a bottom side of said first side rod of said sliding block and said stop portion of said link being stopped against said second side rod of said sliding block when said bearing portion of said link is forced downwards by a bolt body of the toy gun to lower said rear end portion of said link;

said press portion of said hammer is a rigid structure fixedly located on the lateral side of said hammer.

2. The firing actuator mechanism as claimed in claim 1, wherein said bearing portion of said link is located on a top side of said rear end portion.

3. The firing actuator mechanism as claimed in claim 1, wherein said holder block of said retaining mechanism has a chamber defined therein for receiving said sliding block and a spring member mounted in said chamber and connected with said sliding block; said sliding block has a longitudinal sliding slot coupled to said holder block by a pin that limits sliding movement of said sliding block relative to said holder block within a predetermined distance; said engagement portion is formed integral with the front side of said sliding block, said engagement portion being moved out of said holder block when said sliding block is moved forwards relative to said holder block; said first side rod and said second side rod of said sliding block are suspending out of one side of said holder block.

4. The firing actuator mechanism as claimed in claim 1, wherein said engagement portion is forced into engagement with said hook portion of said hammer when said link is moved backwards and said rear end portion of said link is lowered during said single fire mode.

5. The firing actuator mechanism as claimed in claim 1, wherein said engagement portion is disengaged from said hook portion of said hammer when said link is moved backwards and said rear end portion of said link is lowered during said continuous fire mode.

* * * * *